US005918735A

United States Patent [19]

Bando et al.

[11] Patent Number: 5,918,735

[45] Date of Patent: Jul. 6, 1999

[54] PACKAGE FOR STACKED SHEETS, AND PROCESS FOR MANUFACTURING THE SAME

[75] Inventors: Takeshi Bando, Kawanoe; Hiroki Ishikawa, Kanonji, both of Japan

[73] Assignee: Uni-Charm Corporation, Ehime, Japan

[21] Appl. No.: 09/020,891

[22] Filed: Feb. 9, 1998

[30] Foreign Application Priority Data

Feb. 13, 1997 [JP] Japan ..... 9-029066

[51] Int. Cl.[6] ..... B65D 5/00

[52] U.S. Cl. ..... 206/233; 204/494; 53/429; 53/438; 53/381.2

[58] Field of Search ..... 206/812, 494, 206/205, 209, 438, 439, 233; 53/436, 438, 399, 429, 381.2, 463, 477, 478, 479

[56] References Cited

U.S. PATENT DOCUMENTS 4,714,643 12/1987 Kuenzel ..... 206/494 X 5,163,558 11/1992 Palumbo et al. ..... 206/494

FOREIGN PATENT DOCUMENTS

S63-28680 2/1988 Japan .

H6-45381 6/1994 Japan .

*Primary Examiner*—Jacob K. Ackun

*Attorney, Agent, or Firm*—Koda & Androlia

[57] ABSTRACT

A package for stacked sheets to be freely taken out one by one. The stacked sheets are deformed to have their two longitudinal end portions close to each other and to have a recess, and the two end portions are arranged in common planes in the vertical direction. The stacked sheets is enabled to have a generally square top plan shape and to have a small height so that they can be packaged compactly. The sheet to be taken out is pinched upward while being held between the two sides of the recess, and the two sides of the recess are in parallel with the face of an outlet of the envelope. A sheet next to the sheet to be pulled out comes into abutment with the face of the outlet of the envelope at the two sides of the recess so that the sheets are not taken out in a gang.

8 Claims, 3 Drawing Sheets

PACKAGE FOR STACKED SHEETS, AND PROCESS FOR MANUFACTURING THE SAME

BACKGROUND OF THE INVENTION

1. Field of the Invention

The present invention relates to a package such as a hard container or an envelope made of a packaging material such as a film or a sheet for packaging a number of stacked sheets of tissue paper or wet tissues and, more particularly, to a package which can be formed compactly as a whole and allows the stacked sheets to be taken out reliably one by one, and also to a process for manufacturing said package.

2. Prior Art

In the stacked sheets of the prior art such as the tissue paper or wet tissues to be sequentially taken out, each of the sheets is folded into halves, and the end portions of the sheets are overlapped in such a staggered manner that the face of the valley of one two-folded sheet is overlapped on the face of the valley of another two-folded sheet. The numerous stacked sheets thus overlapped are packaged either in a box-shaped container made of paper or plastics or in a envelope made of a packaging material such as a resin film.

The container or the envelope is opened to form an outlet so that when a sheet is pulled out from this outlet, the end portion of the next sheet is dragged out of the outlet by the preceding sheet. As a result, the sheets can be sequentially taken out one by one from the outlet.

In the box tissues of the prior art, however, the stacked sheets are accommodated in a flat position in the container so that the top plan area of the container is increased to enlarge the container itself and to make it inconvenient to transport and handle the container.

Thus, in Japanese Examined Patent Publication No. 6-45381, for example, there is disclosed a technique in which the stacked sheets of tissue paper to be sequentially taken out are packaged in a corrugated state in a container.

According to this disclosure, the stacked sheets having a rectangular top plan are deformed by pressing them in a shorter side direction. Then, a recess formed in a corrugated shape is directed to an outlet side of the container so that the sheets can be sequentially taken out.

However, the aforementioned package for the stacked sheets in a corrugated shape has the following defects.

When the stacked sheets are not deformed and take a flat shape, they usually have a rectangular top plan shape, in which the longer side extends in parallel with a fold of each sheet and the shorter side extends in the direction perpendicular to the fold. Then, the stacked sheets are corrugated to reduce the size of the shorter side so that the appearance gives almost the same impression as before, not small-sized, because the size of the longer side of the rectangle is left long. Rather, the top plan rectangular shape comes emphasized because the size of the shorter side is far smaller than that of the longer side, and the height is enlarged to make the container of place type unstable.

In Unexamined Published Japanese Utility Model Application No. 63-28680, on the other hand, there is disclosed a container in which the stacked sheets deformed into a U-shape are contained. However, these stacked sheets have the following defects.

The stacked sheets are deformed into such a U-shape that the two end portions of the individual stacked sheets at the short side are arranged to confront the take-out face of the container. This remarkably increases the height of the container.

The stacked sheets are wholly bent into a U-shape to have a large height, as described above, so that a recess of the U-shaped stacked sheets is made so deep as to elongate the distance between the outlet of the container and the bottom of the recess. This makes it necessary to raise a next sheet from the bottom of the deep recess when each sheet is taken out one by one from the outlet. As a result, the next sheet may be unable to be protruded from the outlet.

SUMMARY OF THE INVENTION

The object of the present inventon is to solve the above-specified problems of the prior art and to provide both a package for stacked sheets, which can package the stacked sheets in a square or similar top plan shape in a container or an envelope and also can reduce the height size to make the entirety in a small size, and a process for manufacturing the same.

Another object of the present invention is to provide both a package for stacked sheets, which facilitates the protrusion of the leading end portion of a next sheet one by one from an outlet, when the sheets are to be taken out, while preventing the remaining sheets from being taken out to the outside from the outlet, and a process for manufacturing the same.

According to the present invention, there is provided a package for stacked sheets, wherein a plurality of sheets are stacked and packaged in a container or an envelope having an outlet, and the end portion of each sheet is combined with and held between the folded portions of another sheet to be stacked on said each sheet so that the stacked sheets can be sequentially taken out from said outlet, wherein if the direction in which the fold of said folded portions of each sheet extends is longitudinal and if the direction perpendicular to the longitudinal direction is transverse, said stacked sheets have a recess formed apart from said outlet and extended in said transverse direction and are deformed to bring the two longitudinal end portions of the individual stacked sheets close to each other, and wherein if the portion having said outlet is a take-out face of said container or said envelope, the face of the sheet extended from said recess confronts said take-out face, and the edge portion of the uppermost one of said stacked sheets appears in such a position that it can be taken out from said outlet.

In the aforementioned package, said stacked sheets preferably have, before deformed, a rectangular top plan shape having a longer size in said longitudinal direction than in said transverse direction. The stacked sheets preferably have, after deformed, a generally square top plan shape.

The deformed shape of the stacked sheets of the present invention can be exemplified by an inverted Ω-shape or a W-shape.

In the deformation into the inverted Ω-shape, said recess is formed in one row at the center of said stacked sheets, and if the sides perpendicular to said take-out face are the sides of said container or said envelope, the two end portions of the individual stacked sheets in the longitudinal direction are arranged in parallel with said sides.

Moreover, said outlet is preferably opened and extended in the transverse direction perpendicular to the fold of the folded portions of the each sheet. However, the outlet may be extended in the longitudinal direction.

Moreover, the deformed stacked sheets are preferably packaged in the envelope made of a sheet-shaped packaging material, and said envelope preferably has: a first seal formed by welding the two edge portions of said packaging material in the direction, in which said recess of said stacked sheets is extended; and second seals formed by welding the packaging materials at the two end portions in the extending direction of said first seal and extended at a right angle with respect to said first seal.

According to the invention, there is also provided a process for manufacturing a package for stacked sheets, comprising:

the step of forming stacked sheets by combining and holding the edge portion of each sheet between the folded portions of another sheet to be stacked on said each sheet and by stacking a plurality of sheets;

the step of overlapping said stacked sheets and a band-shaped packaging material by aligning the transverse direction of said stacked sheets with the direction to feed said packaging material if the direction in which the fold of the folded portions of each sheet extends is longitudinal and if the direction perpendicular to the longitudinal direction is transverse;

the step of forming a recess extending in the transverse direction at the central portion of said stacked sheets, before or after said stacked sheets are overlapped with said packaging material, and deforming said stacked sheets by bringing the two longitudinal end portions of the individual stacked sheets closer to each other in the longitudinal direction while being arranged in a plane perpendicular to the feed face of said packaging material;

the step of forming a first seal by enveloping the two longitudinal end portions of the deformed stacked sheets with packaging material and by welding the two edge portions of said packaging material in the shorter width direction;

the step of forming second seals perpendicular to said first seal by welding said packaging material at the transverse end portions of said stacked sheets; and the step of separating said packaging material at said second seals into an unit of the individual stacked sheets.

The sheets of the invention are suited for relative thin ones such as wet tissues, dry tissue paper or others.

The container is made of paper or plastics, and the package is made of a packaging material such as a film or other sheets.

In the present invention, the stacked sheets are packaged, while being compressed at their two longitudinal sides, in the container or the envelope so that they can be small-sized as a whole. Thus, the container or the envelope can be formed into a square or similar top plan shape so that its top plan area can be reduced. Moreover, the sheet faces are in parallel with the take-out face of the container or the envelope to reduce the height so that the volume of the container or the envelope can be made smaller than that of the prior art to make small-sized products.

With the two end portions in the longitudinal direction in parallel with the fold of the folded portions of each sheet being close to each other, moreover, though a recess is formed in a direction apart from the outlet so that when a sheet is to be taken out, the next sheet has to be lifted from the recess, since the recess is made shallower than that of the U-shape of the prior art, the sheets can be lifted up reliably one by one so that the leading end portion of the next sheet can be reliably protruded from the outlet.

Since the face of the sheet extended out of the recess confronts the take-out face of the container or the envelope in parallel, still moreover, the sheet next to the sheet being pulled out of the outlet is regulated by the take-out face so that the next sheet is prevented from being wholly dragged by the preceding sheet and wholly taken out of the outlet.

Furthermore, the sheet face appears on the upper face of the stacked sheets and confronts the take-out face of the container or the envelope closely. If the leading end of a next sheet is not protruded from the outlet when one sheet is taken out, the face of the next sheet appears close to the outlet so that the next sheet can be easily taken out.

Especially when the stacked sheets are deformed into the inverted Ω-shape in which the two longitudinal end portions of the individual stacked sheets are arranged along the sides of the container or the envelope, the total height of the stacked sheets can be reduced to set the container or envelope of place type stably. Moreover, the depth of the recess can be reduced to allow the sheets to be taken out sequentially. On the other hand, the faces of the sheets extending to the two sides of the recess, confront the take-out face of the container or the envelope while contacting with each other at the open end of the recess. As a result, the area of the uppermost sheet face confronting the container or the envelope is enlarged so that the end portion of the uppermost sheet can be easily pinched from the outlet. The upper face of the stacked sheets is properly regulated by the take-out face so that it prevents many sheets from being taken-out altogether out of the outlet even when the number of the residing sheets is small.

On the other hand, the envelope for packaging the stacked sheets in accordance with the present invention is manufactured by aligning the feeding direction of a band-shaped packaging material with the transverse direction of the stacked sheets, by deforming the stacked sheets, and by forming a first seal in a manner to envelope the two longitudinal ends in the shrinking direction of the deformation. As a result, the stacked sheets can be packaged in the packaging material while being deformed in the inverted Ω-shape.

DESCRIPTION OF THE PREFERRED EMBODIMENTS

Figure 1:
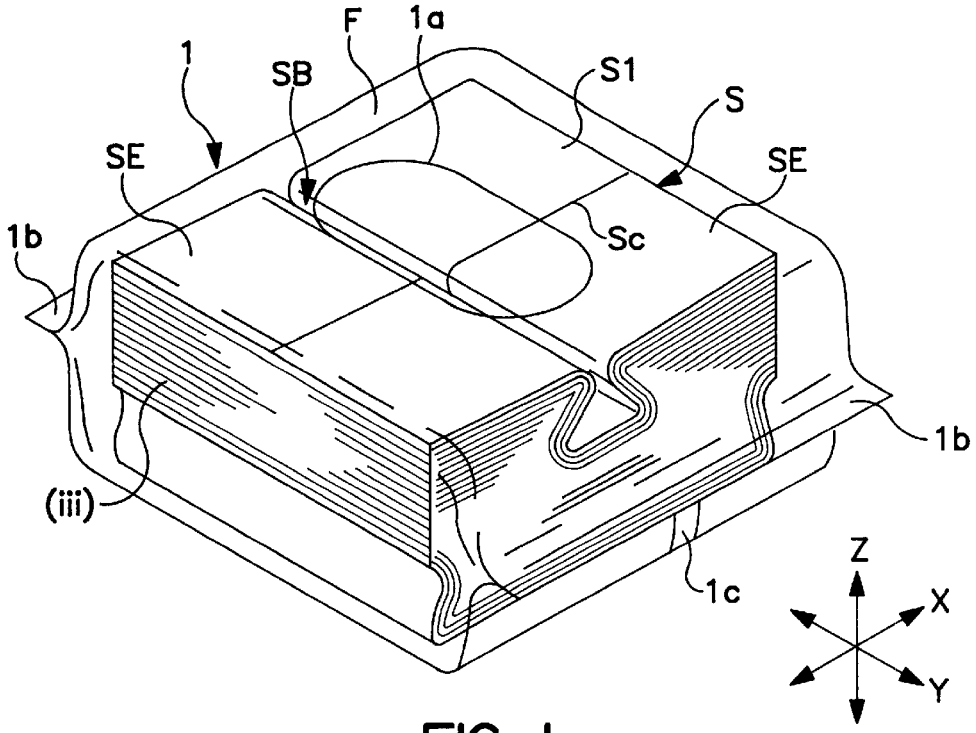
FIG. 1 is a perspective view showing the entirety of a package for stacked sheets according to the present invention.
Figure 2:
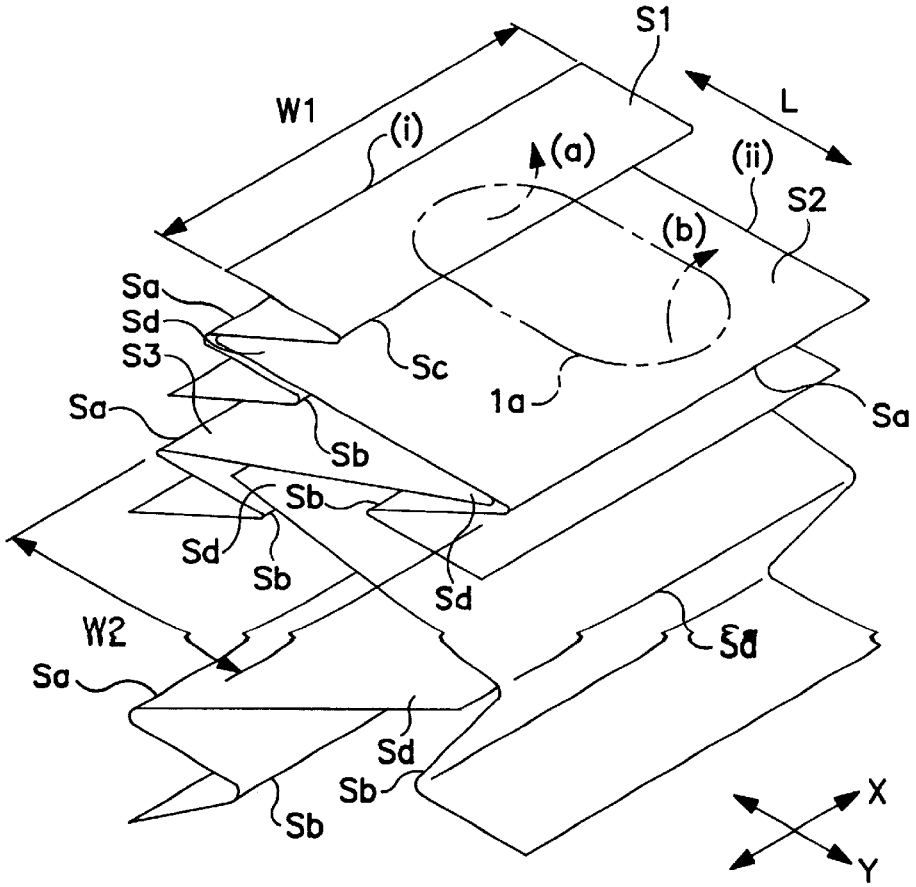
FIG. 2 is a diagram showing the sheets in a stacked state.
Figure 3A:
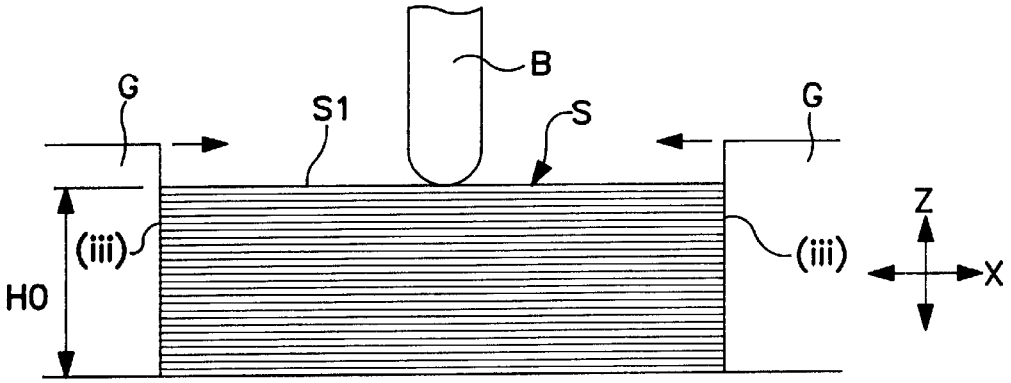
FIG. 3A is a side elevation showing the stacked sheets before deformed.
Figure 3B:
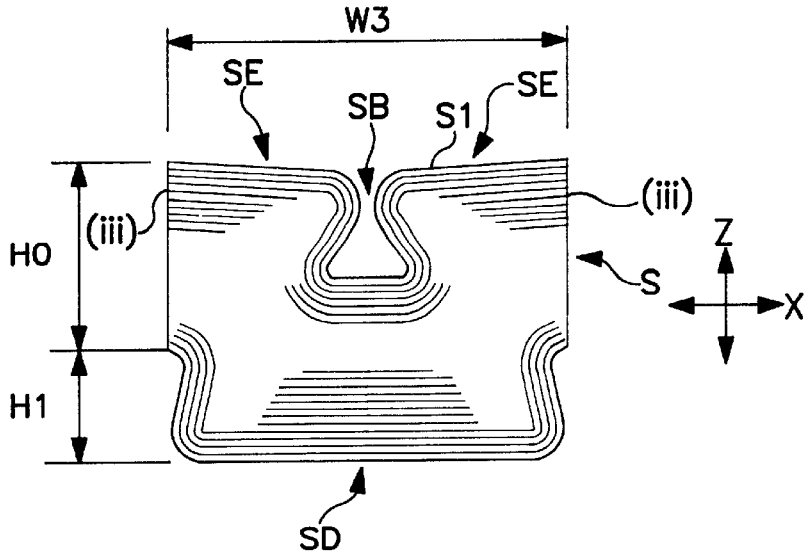
FIG. 3B is a side elevation of the same stacked sheets after deformed as shown in FIG. 3A.

FIG. 1 is a perspective view showing the entirety of a package for stacked sheets according to the present invention; FIG. 2 is a perspective view showing the sheets in a stacked state; and FIGS. 3A and 3B are side elevations showing the deformation process of the stacked sheets.

In the embodiment shown in FIG. 1, stacked sheets S are packaged in an envelope 1. This envelope 1 is made of a packaging material F such as a single layer film of a resin or a laminated film of an aluminum foil and a resin film. Moreover, the inner layer of the packaging material F may be preferably a heat-sealable heat-seal layer. Alternatively, the stacked sheets S may be packaged in a container made of sheet or plastics.

The envelope 1, as shown in FIG. 1, is deformed into a cylinder by weld-sealing the packaging material F at a first seal 1*c* while enveloping the stacked sheets S, and is weld-sealed at second seals 1*b*, as located at the front and back of the envelope 1 in the transverse (Y) direction. The said weld-seal may be practiced by the heat seal or the ultrasonic seal or high-frequency seal. Alternatively, the packaging material may be adhered with an adhesive at the first seal 1*c* and the second seals 1*b* and 1*b*.

In FIG. 1, the X-direction is oriented in the longitudinal direction, and the Y-direction is oriented in the transverse direction. The upper surface of the envelope 1 provides a take-out face, in which an elliptical outlet 1*a* is opened as a slot extending in the transverse (Y) direction generally in the center of the take-out face. The stacked sheets S are folded and stacked in the order of sheets S1, S2, - - - , and so on from the take-out face so that the sheets S1, S2, - - - , and so on are taken out one by one from the outlet 1*a*. When these sheets S1, S2, - - - , and so on are wet tissues impregnated with chemicals, the outlet 1*a* is covered with a cover made of a resin film so that the sheets S1, S2, - - - , and so on are prevented from drying.

FIG. 2 shows one example of the stacked state of the individual stacked sheets S.

These sheets are thin sheets made of pulp fibers such as dry tissue paper or wet tissues. For example, each expanded sheet of the ordinary wet tissues is given a rectangular shape having a shorter side (i) of a size W1 of about 150 mm and a longer side (ii) of a length L of about 200 mm.

Each of the sheets S1, S2, S3 - - - , and so on is folded into halves on a fold Sa generally at the center of the longer side (ii) and in parallel with the shorter side (i), and one half, as divided on said fold Sa, is further folded into halves on a fold Sb in the folding direction opposite to that on the fold Sa. The fold Sb is generally at the center of the longer side (ii) of said one half and is in parallel with the shorter side (i).

The stacked sheets are so alternately stacked that the edge portion Sd of the unfolded half of the lower sheet is held between the folded portions on the fold Sa on the upper sheet. Particularly with respect to the sheet S1, as located at the uppermost position when packaged in the envelope or the container, unfolded one half, which is the counterpart of said one half folded on the fold Sa, is further folded into halves on the fold Sc. As shown in FIG. 1, this fold Sc appears in the outlet 1*a* so that it provides an edge to be taken out from the outlet 1*a*.

As shown in FIG. 2, the fold Sa of each sheet extends in the longitudinal (X) direction. The stacked sheets S in its expanded state before deformed have a longitudinal (X) size of W1 of 150 mm and a transverse (Y) size W2 of 100 mm, for example, and have a rectangular top plan shape having a longer size in the longitudinal (X) direction.

FIG. 3A shows the state before the stacked sheets S are deformed, and FIG. 3B shows the state after the deformation.

In FIG. 3B, both the two end portions (iii) and (iii) of each of the sheets S1, S2, S3 - - - , and so on are arranged on each side into a common plane in the Z direction (perpendicular to both the longitudinal direction and the transverse direction). Then, the stacked sheets S are deformed by pushing said two end portions (iii) and (iii) of the individual stacked sheets S toward each other in the longitudinal (X) direction. As a result, there is formed at the central portion a recess SB in the direction apart from the take-out face (facing the outlet). This recess SB is extended in the transverse (Y) direction perpendicular to the longitudinal (X) direction in which the fold Sa and Sb of the each sheet extend.

In this deforming method, as shown in FIG. 3A, a blade B pushes the general center of the stacked sheets S in the longitudinal (X) direction form above, and setting plates G and G push the two arranged longitudinal end portions (iii) and (iii) of the individual stacked sheets S toward the center of stacked sheets S in the longitudinal (X) direction. By this method, the stacked sheets S can be deformed, as shown in FIG. 3B.

At the take-out face (facing the outlet), as shown in FIG. 3B, the sheet faces SE and SE at the two sides of the recess SB are generally flat in the X-direction, and a bottom face SD, as located at the side opposed to the recess SB, is also generally flat.

When the stacked sheets S thus deformed are packaged in the envelope 1 or the container shown in FIG. 1, their upward and generally flat sheet faces SE and SE are generally in parallel with the upper face (or the take-out face) of the envelope 1 or the container, and the fold Sc (or the edge portion for the take-out) of the uppermost sheet S1 appears in the position where it can be taken out from the outlet 1*a*. Moreover, the two end portions (iii) and (iii) of the each sheet in the longitudinal (X) direction are arranged on each side in the common planes and generally in parallel with the two sides of the envelope 1. On the other hand, the bottom face SD of the stacked sheets S is a plane in parallel with the bottom face of the envelope 1.

In the stacked sheets S, the longitudinal size W1 along the fold Sa is shortened to be a size W3. Since the size W1 is larger before the deformation than the size W2, however, the shortened longitudinal size W3 comes close or becomes equal to the transverse (Y) size W2. As a result, the stacked sheets S take a top plan shape of a general square when they are deformed and packaged in the envelope 1. This reduces the area of the top plan shape of the envelope 1 when the stacked sheets S are packaged.

Moreover, the two end portions (iii) and (iii) of the individual stacked sheets S in the longitudinal direction are arranged along the sides so that their height size in the Z direction is smaller than that of the U-shaped sheets in the prior art. More specifically, the height size of the deformed state shown in FIG. 3B is the addition of a height size H0, as corresponding to the bulk height of the stacked sheets S, and the protrusion size H1 due to the deformation toward the bottom, but this protrusion size H1 is not so large that the total height can be restrained.

Still moreover, two longitudinal end portions (iii) and (iii) of the individual stacked sheets S are compressed in the X direction while being generally flat in the Z direction, the two side ends in the X direction are flat in the Z direction, and both the top and bottom faces are flat so that the sides have a generally square shape, as shown in FIG. 3B. As a result, the curved portions, as appearing when folded in the U-shape, are not formed so that the sheets can be compactly packaged because no clearance is formed between the sheets and the inner faces of the envelope or the container.

Thus, the package for the stacked sheets S is given a generally square top plan shape and a comparatively small height size so that it can be compact as a whole and stable when placed.

When the stacked sheets are to be taken out, the portion of the fold Sc of the uppermost sheet S1 is at first pinched and pulled out of the outlet 1*a*. As shown in FIG. 1, since the sheet faces SE and SE of the uppermost sheet S1 are so close to each other across the recess SB, nearly contacting with each other at the opening end of the recess SB and provide a generally common face as their entire upper face so that the fold Sc appearing at the sheet faces SE and SE can be easily pinched at the portion of the outlet 1*a*. Especially when this outlet is elliptical, as shown in FIG. 1, a more portion of the fold Sc appears from the outlet 1*a* so that it can be easily pinched.

In each sheet, the folded portions on the fold Sa hold the edge portion Sd of another sheet alternately, as shown in FIG. 2, so that the edge portion Sd of the next sheet S2 is dragged out by the sheet S1 to come partially out of the outlet 1*a*, after the sheet S1 is taken out. By repeating these actions, the sheets can be taken out one by one from the outlet 1*a*.

When a sheet is taken out from the outlet 1*a*, as described above, the succeeding sheet is pulled up while its edge portion Sd being held between the folded portions of the preceding one. At this time, the succeeding sheet is pulled up while being held in the recess SB from both the side in the X direction. In the shape shown in FIG. 3B, the recess SB is so shallow that the distance for the sheet to be pulled out from the outlet 1*a* is not so large to cause the resistance. Thus, the take-out is so facilitated that after one sheet is taken out from the outlet 1*a*, the leading end portion of the succeeding sheet can be reliably protruded from the outlet 1*a*.

As the succeeding sheet is dragged by the preceding sheet to the outlet 1*a*, moreover, the sheet faces SE and SE come into abutment against the inner side of the take-out face of the envelope 1, by which the sheet is pushed downward. This prevents the phenomena, in which the next sheet and a gang of succeeding sheets are dragged altogether from the outlet 1*a*, so that the sheets can be reliably pulled out one by one.

Still moreover, the fold Sa entangling the upper and lower sheets extends in the X-direction, and the valley of the recess SB extends in the Y-direction perpendicular to the direction of the aforementioned fold Sa. This substantially prevents the phenomenon in which when the edge portion Sd of the sheet is lifted up from the inside of the recess SB by the preceding sheet, the entire sheet slides along the curved face of the recess SB. This also ensures the reliable take-out of each sheet.

Moreover, since the each sheet S1, S2, - - - , and so on are stacked alternately in the staggered manner, as shown in FIG. 2, the sheet S1 is pulled out in the direction, as indicated by arrow (a), and the sheet S2 is pulled out in the direction opposed to that of the sheet S1, as indicated by arrow (b). In the embodiment shown in FIG. 1, the outlet 1*a* is opened to extend in the transverse (Y) direction perpendicular to the fold Sc of the sheet so that the longitudinal opening direction of the outlet 1*a* are in the aforementioned directions (a) and (b). Thus, the sheets to be pulled out in the directions (a) and (b) receive a little sliding resistance from the edge portion of the outlet 1*a* so that they can be easily taken out one by one.

Despite of this arrangement, however, the longitudinal opening direction of the outlet 1*a* may be oriented in the longitudinal (X) direction, as opposed to that shown in FIG. 1. In this modification, a most portion of the fold Sc or the take-out edge portion of the uppermost sheet S1 appears in the outlet 1*a* so that the fold Sc can be easily pinched by the hand from the outlet 1*a*. On the other hand, the shape of this outlet 1*a* should not be limited to the elliptical one but may be a slit shape.

Figure 4A:
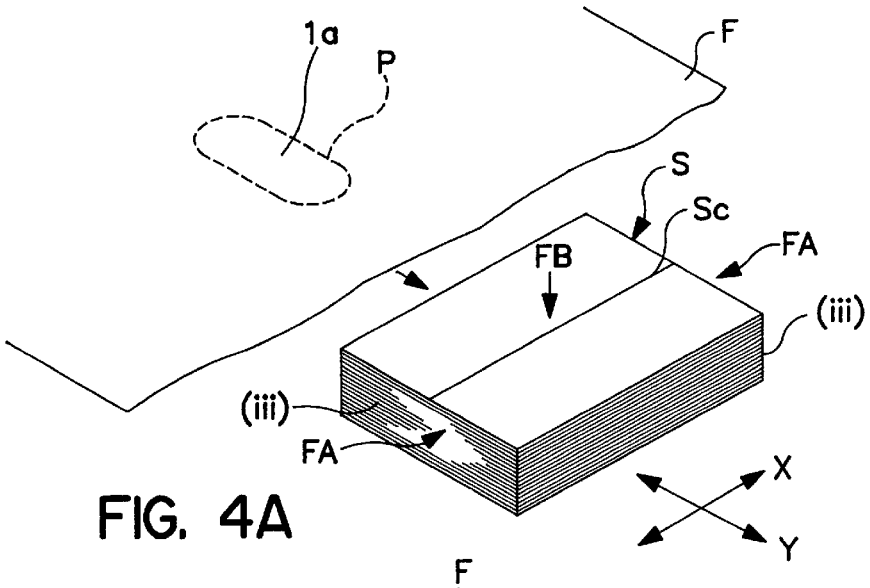
FIGS. 4A, 4B and 4C are perspective views showing the process for manufacturing the package for stacked sheets shown in FIG. 1.
Figure 4B:
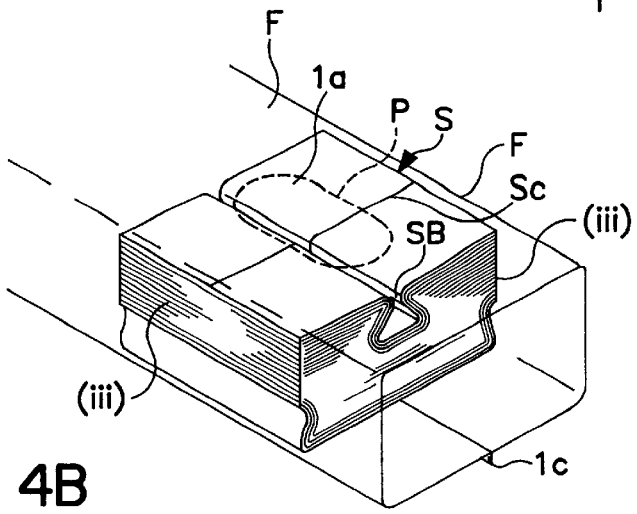
Figure 4C:
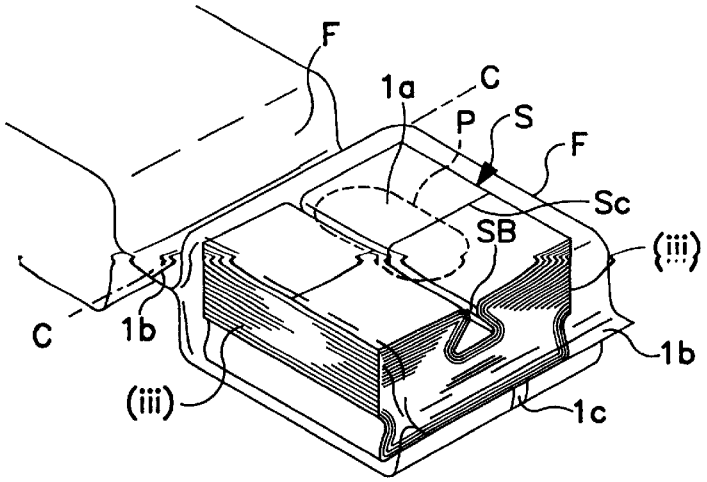

FIGS. 4A, 4B and 4C show one embodiment of the process for manufacturing the aforementioned envelope 1.

As shown in FIG. 4A, the band-deformed packaging material F is fed continuously or intermittently in the transverse (Y) direction. This packaging material F is perforated in advance with elliptical perforations P extending in the transverse (Y) direction. The portion, as enclosed by these perforations P, provides the outlet 1*a*.

The stacked sheets S are deformed into an inverted Ω-shape, as shown in FIG. 3B, by applying the blade B and the setting plates G and G to the stacked sheets S in advance, as shown in FIG. 3A, and then pushing the stacked sheets S at their central portion by a downward force FB and the longitudinal forces FA and FA to the two end portions (iii) and (iii), as shown in FIG. 4A. Alternatively, the stacked sheets S may be deformed into the inverted Ω-shape by using other guiding structure. Immediately after this deformation, the packaging material F is fed onto the stacked sheets S to be arranged in a manner that the center of the uppermost sheet S1 of the stacked sheets S may come to the portion of the perforations P of the packaging material F. At this time, the transverse (Y) direction, which is perpendicular to the folds Sa, Sb and Sc of the each sheet along to the longitudinal (X) direction, is aligned with the direction for feeding the packaging material F.

Alternatively, while being overlapped with the packaging material F in a face-to-face state but before being enveloped, the stacked sheets S in a flat state may be deformed into the inverted Ω-shape, by pushing the central portion of the stacked sheets S by the downward force FB and by applying the longitudinal forces FA and FA to the two end portions.

After the stacked sheets S and the packaging material F were overlapped, the stacked sheets S are so enveloped with the packaging material F that their two edge portions in the shorter width direction may be joined, and the two edge portions of the packaging material F are brought into a contacting state and are welded to each other by the heat seal or the ultrasonic seal, to form the first seal 1*c*, as shown in FIG. 4B. At this time, the stacked sheets S are enveloped by the packaging material F in the longitudinal (X) direction or their shrinking direction, so that the stacked sheets S can be packaged with the packaging material F while retaining the inverted Ω-shape in the packaging process.

Then, the packaging material F is held at the two end portions of the individual stacked sheets S in the transverse (Y) direction, and welded by the heat seal or the ultrasonic seal, to form the second seals 1*b*, as shown in FIG. 4C. Then, the single package of the stacked sheets is separated at the second seal 1*b* along a cutting line C—C.

In FIGS. 4A, 4B and 4C, the packaging material F is fed over the stacked sheets S, and the two end portions in the shorter side direction are gathered at the lower side of the stacked sheets S to make the longitudinal seal. When the stacked sheets S are turned upside down to direct the sheet S1 downward so that they are formed into the Ω-shape by applying the upward force FB, the packaging material F is fed below the stacked sheets S so that the first seal 1C is formed above the stacked sheets S. In FIGS. 4A, 4B and 4C, moreover, the description has been made on the case in which the stacked sheets are packaged by the envelope made of the packaging material F of a resin film. When the stacked sheets are to be packaged in a container made of paper or plastics, on the other hand, the deformed stacked sheets can be packaged in the container while keeping their shape, by the step of enveloping the two end portions (iii) and (iii) of the deformed stacked sheets with the side walls of the container and closing the container in the transverse direction.

Figure 5:
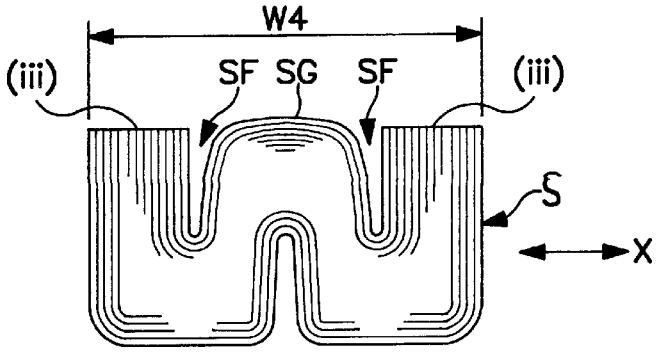
FIG. 5 is a side elevation showing a package for stacked sheets of another embodiment according to the present invention.

FIG. 5 is a side elevation showing the deformed state of stacked sheets constructing another embodiment of the present invention.

The stacked sheets S are identical, before deformed, to those shown in FIGS. 2 and 3A. In FIG. 5, the two end portions (iii) and (iii) of the each sheet are arranged and directed to the take-out side of the envelope 1. Moreover, two recesses SF and SF are formed to leave a ridge protruded toward the outlet at their intermediate portion so that the entirety has a W-shape. The crest of said ridge between the recesses SF and SF provides a flat sheet face SG extending in the X-direction, and this sheet face SG confronts the take-out face of the container or the envelope and appears in the outlet.

In this deformed state of the stacked sheets S, the X-direction size which is the longer side before the deformation can be reduced to W4 so that the entirety can be small-sized. By providing the two recesses SF and SF, moreover, the entirety can be lowered. It is further possible to arrange the sheet face SG and the two end portions (iii) and (iii) of the individual stacked sheets S generally in a common plane, to make the bottom face opposite to the sheet face SG flat, and to make the end faces of FIG. 5 rectangular thereby. Thus, the stacked sheets S can be packaged compactly in the container or the envelope.

Further, the sheets S1, S2, - - - , and so on are to be taken out, while the edge portion Sd of the succeeding sheet is held between the recesses, so that the stacked sheets S are not taken out in a gang of several sheets but can be taken out reliably one by one. Still moreover, the surface of the ridge SG is in parallel with the face at the outlet side so that the sheet can be easily pinched and taken out from the outlet 1*a*. When one sheet is taken out, furthermore, the ridge SG of the next sheet is brought into abutment against the face of the outlet side so that the succeeding sheets are not taken out in a gang.

The shape of the stacked sheets should not be limited to the foregoing shapes but can be modified into another by changing the applying position of the blade B, or the manner to push the stacked sheets S with the setting plates G and G.

In the present invention thus far described, the recess is formed in the direction perpendicular to the longitudinal direction, in which the folds of the sheets is extended, and the two end portions in the longitudinal direction are deformed to come close to each other, so that the top plan shape after deformation can be made generally square to package the stacked sheets compactly as a whole.

When one sheet is taken out, moreover, the next sheet is pulled up from the inside of the recess while being pinched between the two sides of the recess. Still moreover, the sheet faces at the two sides of the recess are in parallel with the face in which the outlet is opened. As a result, the next sheet is brought into abutment against the face of the outlet side of the container or the envelope so that it is retained in the direction apart from the outlet. Thus, several sheets are not pulled up in a gang, but the uppermost sheet can be easily taken out reliably one by one.

When the two end portions in the longitudinal direction are arranged along the sides of the container or the envelope, the height size can be reduced and the side shape can also be made generally rectangular, as shown in FIG. 3B, so that the package can be made compact as a whole.

In the process for manufacturing the package to package those deformed sheets, on the other hand, the stacked sheets are pushed and deformed to bring their two end portions closer to each other, and these two end portions are then packaged and sealed by the envelope or the container. Thus, the stacked sheets can be packaged while keeping their deformed state.

What is claimed is:

1. A package for stacked sheets, wherein:

a plurality of sheets are stacked and packed in a container having an outlet, and an end portion of each sheet is combined with and held between folded portions of another sheet stacked on said each sheet so that the stacked sheet are sequentially taken out from said outlet, a direction in which a fold of said folded portions of each sheet extends is a longitudinal direction and a direction perpendicular to the longitudinal direction is a transverse direction, said stacked sheets have a recess formed apart from said outlet and extending in said transverse direction, the stacked sheets are deformed to bring the two longitudinal end portions of the individual stacked sheets close to each other, and a portion having said outlet is a take-out face of said container and a face of an uppermost one of said stacked sheets extending from said recess confronts said take-out face, and an edge portion of the uppermost one of said stacked sheets is at a position that it can be taken out from said outlet.

2. A package for stacked sheets according to claim 1, wherein said stacked sheets have, before being deformed, a rectangular top plan shape being longer in the longitudinal direction than in the transverse direction, and after being deformed, a generally square top plan shape.

3. A package for stacked sheets according to claim 1, wherein said recess is formed in one row at a center of said stacked sheets, and if sides perpendicular to said take-out face are the sides of said container, the two end portions of the stacked sheets in the longitudinal direction are arranged in parallel with said sides.

4. A package for stacked sheets according to claim 1, wherein said outlet is open and extends in the transverse direction perpendicular to the fold of the folded portions of the each sheet.

5. A package for stacked sheets according to claim 1, wherein the deformed stacked sheets are packaged in the container made of a sheet-shaped packaging material, and said container comprises: a first seal formed by welding two edge portions of said packaging material in a direction in which said recess of said stacked sheets extends; and second seals are formed by welding the packaging materials at the two end portions at ends of said first seal and said second seals extend at a right angle with respect to said first seal.

6. A process for manufacturing a package for stacked sheets, comprising:

a step of forming stacked sheets by folding a plurality of sheets each into at least two folded portions and then stacking the sheets together in such a manner that one folded portion of one sheet is held between folded portions of another sheet which is stacked on the sheet;

a step of overlapping the stacked sheets, wherein a direction in which folds of the sheets extend is defined as a longitudinal direction and a direction which is perpendicular to the longitudinal direction is defined as a transverse direction, with a band-shaped packaging material by aligning the transverse direction of the stacked sheets with a direction to feed the packaging material;

a step of deforming the stacked sheets, before or after the step of overlapping the stacked sheets with the packaging material, by pressing a center of the stacked sheets and bringing two longitudinal end portions of the stacked sheets closer to each other, while being arranged in a plane which is perpendicular to the packaging material, so as to form a recess which extends in the transverse direction;

a step of forming a first seal by overlapping two longitudinal end portions of the stacked sheets after being deformed with the packaging material and by welding two edge portions of the packaging material in a shorter width direction of the packaging material;

a step of forming second seals which are at right angles to the first seal, by welding the packaging material having the first seal at two transverse end portions of the stacked sheets; and a step of separating the packaging material at the second seals into a unit of stacked sheets.

7. A process for manufacturing a package for stacked sheets according to claim 6, wherein said stacked sheets have, before being deformed, a rectangular top plan shape being longer in the longitudinal direction than in the transverse direction and, after being deformed, a generally square top plan shape.

8. A process for manufacturing a package for stacked sheets according to claim 6, wherein an outlet is opened in said packaging material extending in the transverse direction.

* * * * *